United States Patent [19]

Regnier

[11] Patent Number: 5,009,611

[45] Date of Patent: Apr. 23, 1991

[54] HIGH DENSITY ELECTRICAL CONNECTOR FOR PRINTED CIRCUIT BOARDS

[75] Inventor: Kent Regnier, Lombard, Ill.

[73] Assignee: Molex Incorporated, Lisle, Ill.

[21] Appl. No.: 527,464

[22] Filed: May 23, 1990

[51] Int. Cl.[5] ..... H01R 13/00

[52] U.S. Cl. ..... 439/326

[58] Field of Search ..... 439/296, 325, 326, 629–637

[56] References Cited

U.S. PATENT DOCUMENTS 4,713,013 12/1987 Regnier et al. ..... 439/326

*Primary Examiner*—Joseph H. McGlynn

*Attorney, Agent, or Firm*—Louis A. Hecht; Stephen Z. Weiss; A. A. Tirva

[57] ABSTRACT

A connector assembly is provided for electrically connected closely-spaced circuit elements disposed on two printed circuit boards one of which has a mating edge and a surface with a linear array of contact pads adjacent the edge. An elongate dielectric housing has a cavity along its length for receiving the mating edge of the one printed circuit board. The housing is mountable to the other of the printed circuit boards. A plurality of thin contact members are mounted on the housing to form a closely-spaced linear terminal array. Each contact member is adapted to engage a contact pad when the one printed circuit board is inserted into the cavity. Each contact member has a mounting socket, and the housing has a mounting post positionable in the mounting socket to seat the contact member on the housing.

13 Claims, 2 Drawing Sheets

HIGH DENSITY ELECTRICAL CONNECTOR FOR PRINTED CIRCUIT BOARDS

FIELD OF THE INVENTION

This invention generally relates to electrical connectors and, particularly, to an improved high density multi-circuit electrical connector of the type adapted for making edge connections with printed circuit boards.

BACKGROUND OF THE INVENTION

Multi-circuit electrical connectors of the type adapted for mounting on a printed circuit board typically include a plurality of electrical contact members or terminals disposed within a unitary dielectric housing, normally a molded plastic housing in which the contacts are inserted following molding. In these arrangements, the housing typically surrounds portions of the terminals immediately adjacent the printed circuit board to provide rigid support for the terminals.

Examples of such electrical connector assemblies are shown in Regnier et al. U.S. Pat. No. 4,713,013, dated Dec. 15, 1987, and Walse U.S. Pat. No. 4,780,093, dated Oct. 25, 1988, both of which are assigned to the assignee of this invention.

In accordance with continuing advances in the electronics art, the desire for increased connector miniaturization results in continuously increasing circuit density. This requires that the electrical terminals in the dielectric housing become smaller and smaller and more difficult to support within the housing. The terminals are fabricated from very thin sheet metal material with integral components.

For instance, in the aforesaid Regnier et al. U.S. Pat. No. 4,713,013, the contacts or terminals are rigidly supported on the housing by means of integral barbed posts projecting from the terminals and seated within sockets molded in the plastic housing. With increasing miniaturization, the sockets for the posts become to narrow too manufacture with increased density. If the sockets are turned into long continuous slots extending lengthwise of the housing, problems arise because of variations in the posts and the distance between posts from terminal to terminal.

This invention is directed to solving the above problems by providing an improved connector assembly of the character described wherein the retention means between the contacts or terminals and the housing are adapted for very high density arrangements and still provide rigid support between the contacts and the housing.

SUMMARY OF THE INVENTION

An object, therefore, of the invention is to provide a new and improved connector assembly for electrically connecting closely-spaced circuit elements disposed on two printed circuit boards one of which has a mating edge and a surface with a linear array of contact pads adjacent the edge.

In the exemplary embodiment of the invention, an elongate dielectric housing is provided with a cavity along its length for receiving the mating edge of the one printed circuit board. Means are provided for mounting the housing to the other of the printed circuit boards. A plurality of thin contact members are mounted on the housing to form a closely-spaced linear terminal array, each contact being adapted to engage a contact pad when the one printed circuit board is inserted into the cavity. Each contact has a mounting socket. The housing has a mounting post positionable in the mounting socket of each contact member to seat the contact members on the housing.

As disclosed herein, the housing is fabricated of molded plastic material and includes a plurality of narrow, closely-spaced slots extending transversely of the cavity for receiving the thin contact members. In one form of the invention, a pair of the mounting posts are disposed on the housing outside the ends of each slot. Each contact member has a pair of sockets for seating therewithin a respective pair of the mounting posts.

Also as disclosed herein, the contact members have opposed spring contact arms extending into the slots in the housing for engaging the contact pads on the mating edge of the one printed circuit board. In another form of the invention, the mounting sockets in the contacts are disposed between the contact arms for receiving complementary mounting posts on the housing.

Other objects, features and advantages of the invention will be apparent from the following detailed description taken in connection with the accompanying drawings.

BRIEF DESCRIPTION OF THE DRAWINGS

The features of this invention which are believed to be novel are set forth with particularity in the appended claims. The invention, together with its objects and the following description taken in conjunction with the accompanying drawings, in which like reference numerals identify like elements in the figures and in which:

DETAILED DESCRIPTION OF THE PREFERRED EMBODIMENTS

Figure 1:
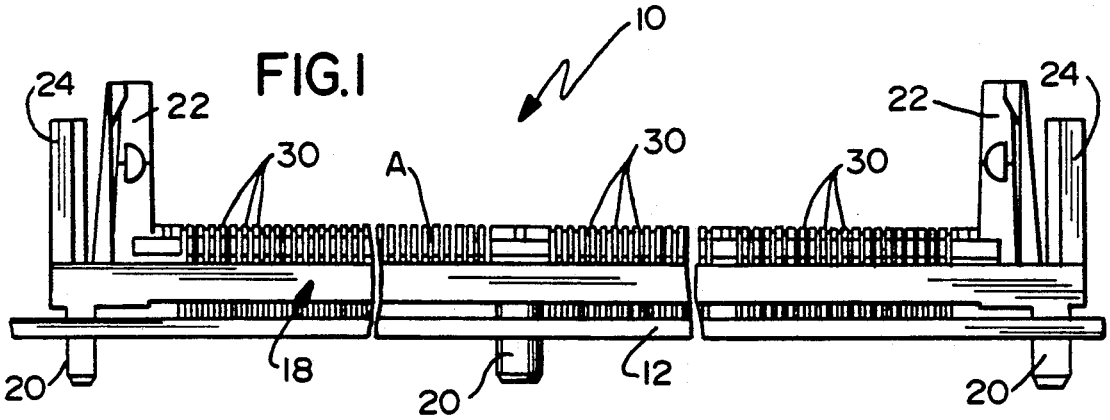
FIG. 1 is a side elevational view of a connector assembly embodying the concepts of the invention, mounted on a high density printed circuit board.
Figure 2:
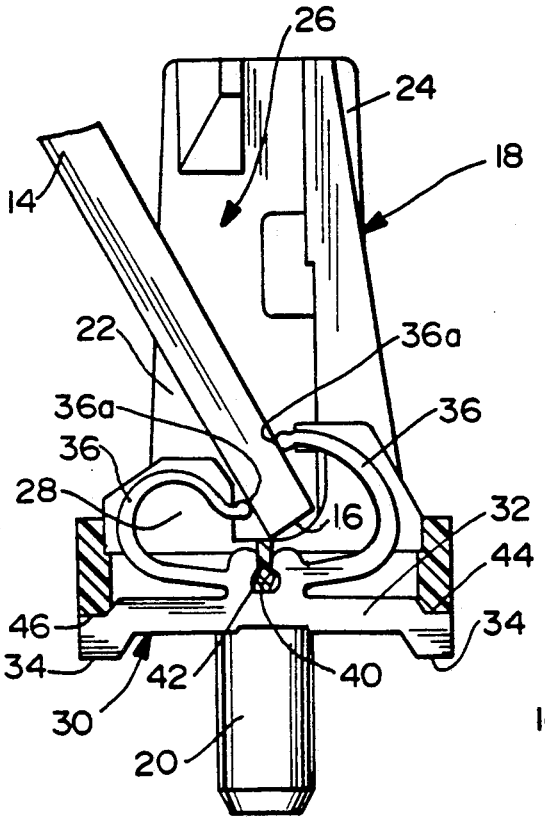
FIG. 2 is a vertical section taken generally along line 2—2 of FIG. 1 and shown receiving an edge of another printed circuit board.

Referring to the drawings in greater detail, and first to FIGS. 1 and 2, a connector assembly, generally designated 10, is provided for electrically connecting closely-spaced circuit elements disposed on two printed circuit boards 12 (FIG. 1) and 14 (FIG. 2). Printed circuit board 12 commonly is termed a mother board and is a high density printed circuit board including a plurality of closely-spaced circuit elements on at least one major surface thereof. Printed circuit board 14 commonly is termed an edge card and includes a mating edge 16 and a surface with a linear array of contact pads disposed in alignment adjacent the mating edge. Details of such a connector arrangement are shown in the aforesaid Regnier U.S. Pat. No. 4,713,013 which is incorporated herein by reference.

Suffice it to say, connector assembly 10 includes a housing, generally designated 18, having depending mounting bosses 20 extending from the lower surface of the housing and adapted to be received within appropriate mounting apertures in mother board 12. In addition, the housing has a pair of upstanding mounting posts 22 and yieldable latch posts 24 at opposite ends of the housing for yieldably retaining edge card 14 in mated relationship with housing 18. Again, further details of such an arrangement can be derived from the aforesaid '013 patent.

Referring particularly to FIG. 2, housing 18 is molded integrally of plastic material and includes a cavity 26 along its length for receiving mating edge 16 of edge card or printed circuit board 14. A plurality of closelyspaced compartments or narrow slots 28 are disposed along cavity 26, transversely of the cavity along the length of housing 18, for receiving a plurality of thin contact members, generally designated 30, to form a closely-spaced linear terminal array as shown generally at "A" in FIG. 1.

Each contact 30 has a terminal bus bar 32 provided with lower terminal pads 34 adapted to engage contact pads on mother board 12. Contacts 30 are spring contact terminals and have rounded continuously curved, generally C-shaped spring contact arms 36 with distal ends 36*a* adapted to engage contact pads on edge card 14. Again, a similar C-shaped spring contact terminal is disclosed in detail in the U.S. Pat. No. 4,713,013 which is incorporated herein by reference.

Each contact 30 is mounted to and rigidly supported on housing 18 by means of a mounting socket 40 stamped integral with thin contact 30 generally centrally thereof and opening upwardly toward the gap between distal ends 36*a* of spring contact arms 36. Housing 18 has an integrally molded mounting post 42 positionable in mounting socket 40 by means of a press fit to seat the contact member onto the housing. It can be seen in FIG. 2 that mounting socket 40 is interiorly enlarged and mounting post 42 has an enlarged head portion to securely seat the post in the socket, as by a snap-fit. Abutting surfaces 44 at each end of bus 32, on the top thereof, and complimentarily abutting surfaces 46 on housing 18 stabilize the contact members securely to the housing.

Figure 3:
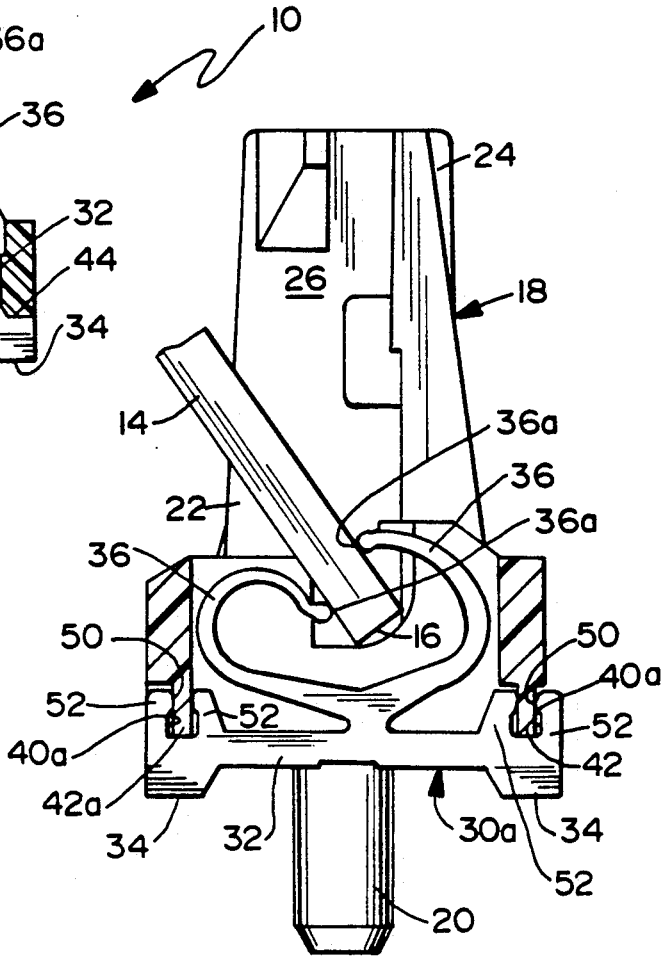
FIG. 3 is a sectional view similar to that of FIG. 2, showing another form of the invention.

FIG. 3 shows an alternate form of the invention wherein a pair of mounting sockets and mounting posts are provided between contacts 30 and housing 18. Otherwise, like numerals have been applied to designate like components of the connector assembly as described above in relation to FIGS. 1 and 2.

More particularly, the contact member in FIG. 3 is designated 30*a* and includes a pair of mounting sockets 40*a* opening upwardly at opposite ends of bus 32. Housing 18 is formed with a pair of integrally molded mounting posts 42*a* which are sized to press fit into mounting sockets 40*a* of contact 30*a*. Each mounting socket 42*a* has a mouth 50 between a pair of small arms 52, the mouth between the arms being slightly smaller than the width of mounting posts 42*a*. Therefore, arms 52 apply inwardly directed biasing forces against the mounting posts to securely hold the contact members to the housing.

The forms of the inventions shown in FIGS. 2 and 3 have their own distinct advantages. The arrangement of the single mounting socket 40 and mounting post 42, centrally located as shown in FIG. 2, has the advantage of requiring less transverse space, particularly when it is desirable to securely abut the contacts against the housing, as by abutting surfaces 44, 46.

The arrangement of the two outside mounting sockets 40*a* and mounting posts 42*a* in the form of the invention shown in FIG. 3 has an advantage of providing additional retention of the contact members on the housing and the additional support such an arrangement supplies to the terminal bus to prevent any rotation of the contacts on the housing. Another advantage of this form of the invention is that the location of the terminal retention means can be placed anywhere on the terminal bus, outside the juncture of C-shaped spring arms 36 with the bus, to optimize the design of the C-shaped arms for optimum manufacturing and functional characteristics.

Figure 4:
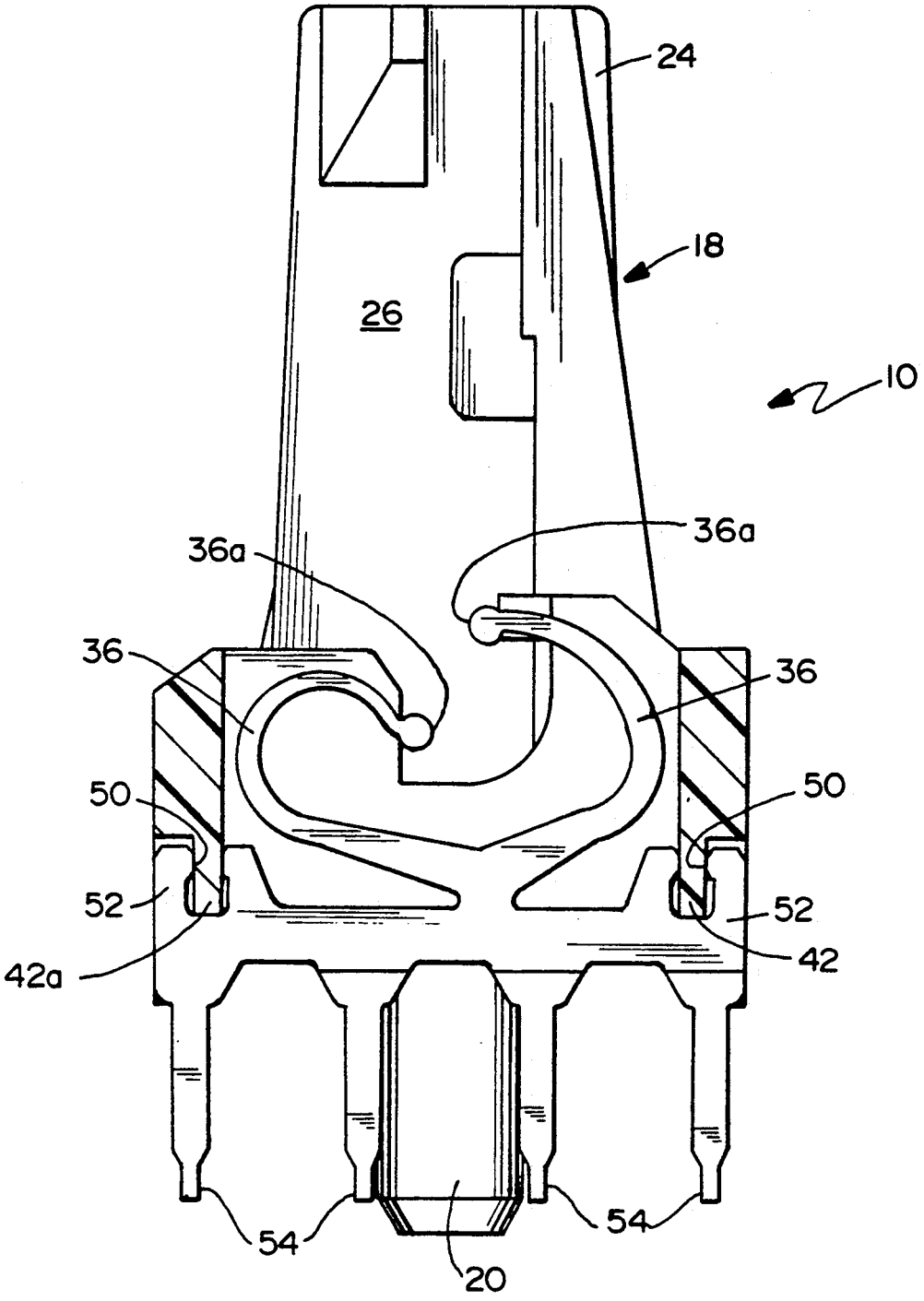
FIG. 4 is a sectional view similar to that of FIG. 3 showing another form of the invention.

FIG. 4 shows a further alternate form of the invention in FIG. 3 wherein the terminal bus bar 32 is provided with solder tails 54 in place of terminal pads 34. The solder tails 54 are adapted to engage apertures in the motherboard 12. Solder tails can also be provided to the bus bar 30 in place of terminal pads 34 in FIG. 2.

All forms of the invention have the main advantages described above in affording manufacturing capabilities of extremely high density contact/connector arrangements. In addition, all are readily amenable to bottom loading onto the housing and provide large areas for surface mount technology attachments on mother board 12 and multiple locations available for the attachments along the entire length of bus 32.

It will be understood that the invention may be embodied in other specific forms without departing from the spirit or central characteristics thereof. The present examples and embodiments, therefore, are to be considered in all respects as illustrative and not restrictive, and the invention is not to be limited to the details given herein.

I claim:

1. A connector assembly for electrically connecting closely-spaced circuit elements disposed on two printed circuit boards one of which has a mating edge and a surface with a linear array of contact pads adjacent said edge, comprising:

an elongate dielectric housing having a cavity along its length for receiving the mating edge of said one printed circuit board;

means for mounting the housing to the other of the printed circuit boards;

a plurality of thin contact members mounted on the housing to form a closely-spaced linear terminal array, each contact member being adapted to engage a contact pad when the one printed circuit board is inserted into the cavity, and each contact member having a mounting socket; and said housing having a mounting post positionable in the mounting socket of each contact member to seat the contact members on the housing.

2. The connector assembly of claim 1 wherein each of said contact members has contact arm means extending into a respective slot in the housing for engaging at least one contact pad on the mating edge of the one printed circuit board, and said mounting socket is located outside the contact arm means.

3. The connector assembly of claim 1 wherein each of said contact members has a bus bar extending transversely of the housing, and said socket is located at one end of the bus bar.

4. The connector assembly of claim 1 wherein said housing includes a plurality of narrow, closely-spaced slots extending transversely of the cavity for receiving the thin contact members, the contact members include spaced, opposed spring contact portions extending into the respective slots, and said mounting sockets are disposed between the opposed spring contact portions.

5. The connector assembly of claim 1 wherein said housing includes a plurality of narrow, closely-spaced slots extending transversely of the cavity for receiving the thin contact members and a pair of said mounting posts disposed transversely outside each slot, and each contact member has a pair of said sockets for seating therewithin a respective pair of the mounting posts.

6. The connector assembly of claim 5 wherein said contact members have opposed spring contact arms extending into the slots in the housing for engaging the contact pads on the mating edge of the one printed circuit board, and said mounting sockets are located outside the spring contact arms.

7. The connector assembly of claim 5 wherein said contact members have bus bars extending transversely of the housing, and said sockets are located at opposite ends of the bus bars.

8. The connector assembly of claim 7 wherein said means for mounting the housing to the other of the printed circuit boards includes solder tails located at the bottom of said bus bars insertable into apertures in the other of the printed circuit boards.

9. The connector assembly of claim 7 wherein said bus bars have solder tails insertable into apertures in the other of the printed circuit boards.

10. The connector assembly of claim 7 wherein said bus bars have bottom terminal pads for engaging contact pads on the other of the printed circuit boards.

11. A connector assembly for electrically connecting closely-spaced circuit elements disposed on two printed circuit boards one of which has a mating edge and a surface with a linear array of contact pads adjacent said edge, comprising:

an elongate dielectric housing having a cavity along its length for receiving the mating edge of said one printed circuit board, the housing including a plurality of narrow, closely-spaced slots extending transversely of the cavity;

means for mounting the housing to the other of the printed circuit boards;

a plurality of thin contact members mounted on the housing to form a closely-spaced linear terminal array, each contact member having a bus bar extending below and transversely of the housing, contact arm means extending from the bus bar into the slot for engaging at least one contact pad on the mating edge of the one printed circuit board, and a mounting socket in at least one end of the bus bar outside the contact arm means; and said housing having a mounting post positionable in the mounting socket of each contact member to seat the contact members on the housing.

12. The connector assembly of claim 11, wherein said means for mounting the housing to the other of the printed circuit boards includes solder tail means located at the bottom of each of said bus bar insertable into aperture means in the other of the printed circuit boards.

13. A connector assembly for electrically connecting closely-spaced circuit elements disposed on two printed circuit boards one of which has a mating edge and a surface with a linear array of contact pads adjacent said edge, comprising:

an elongate dielectric housing having a cavity along its length for receiving the mating edge of said one printed circuit board, the housing including a plurality of narrow, closely-spaced slots extending transversely of the cavity;

means for mounting the housing to the other of the printed circuit boards;

a plurality of thin contact members mounted on the housing to form a closely-spaced linear terminal array, each contact member having opposed C-shaped spring contact arms extending into a slot in the housing with distal ends of the contact arms engageable with contact pads on the mating edge of the one printed circuit board, and each contact member having a mounting socket between opposite ends of the C-shaped spring contact arms; and said housing having a mounting post positionable in the mounting socket of each contact member to seat the contact members on the housing.

* * * * *